United States Patent [19]

Fattori

[11] Patent Number: 4,570,826

[45] Date of Patent: Feb. 18, 1986

[54] DISPENSER CLOSURE

[75] Inventor: Lazzaro A. Fattori, Atlantis, Fla.

[73] Assignee: The Rel Corporation, Montclair, N.J.

[21] Appl. No.: 480,703

[22] Filed: Mar. 31, 1983

[51] Int. Cl.[4] ..... B65D 47/36

[52] U.S. Cl. ..... 222/83; 222/89; 222/153; 222/518; 222/541; 222/511

[58] Field of Search ..... 222/528–529, 222/513, 81, 83, 83.5, 89–90, 541, 153, 505, 507–509, 511, 517–518, 515, 544–545, 559; 251/342, 354

[56] References Cited

U.S. PATENT DOCUMENTS

| | | | |
|---|---|---|---|
| 3,263,875 | 8/1966 | Lofdahl | 222/518 |
| 3,595,445 | 7/1971 | Buford | 222/511 X |
| 4,368,832 | 1/1983 | Lambert | 222/509 |
| 4,375,864 | 3/1983 | Sauale | 222/81 |

FOREIGN PATENT DOCUMENTS

| | | | |
|---|---|---|---|
| WO81/02418 | 9/1981 | PCT Int'l Appl. | 222/83 |
| 2082152 | 3/1982 | United Kingdom | 222/83 |
| 2096284 | 10/1982 | United Kingdom | 222/83 |

*Primary Examiner*—Charles A. Marmor

[57] ABSTRACT

A two piece dispenser closure, comprising a housing and an interior valve member, is molded of elastomeric plastic material for snap-on mounting on the delivery end of a tubular spout of the flexible plastic container of a liquid in bag-in-a-box packaging. The housing has a valve seat formed with an opening and a forward extension formed as a hollow compressible push button. The interior valve member has a valve body with a forward portion extending into the push button. The valve body is mounted on a normally forwardly convex annular diaphragm which retains the valve body in a seated, closed position in the housing valve seat. The diaphragm is formed with openings and is resiliently deformable to an invaginated configuration when an inward force is applied to the valve body forward portion through the push button to unseat the valve body whereby liquid flows from the tubular spout through the diaphragm openings, between the valve body and valve seat and is dispensed through the valve seat opening. Upon release of the push button, the latter and diaphragm return to normal valve closing position. In a three piece construction, the valve member has a sleeve engaging the interior surface of the tubular spout which mounts a cap in stopper fashion or a bonded puncturable disc as a seal for the inlet end of the tubular spout, the cap and disc being gas impermeable.

26 Claims, 17 Drawing Figures

DISPENSER CLOSURE

BACKGROUND OF THE INVENTION

1. Field of the Invention

This invention relates to dispenser closures for tubular spouts through which pourable commodities may be dispensed by gravity or pressure induced flow from flexible plastic containers of, for example, bag-in-a-box packaging and more particularly is directed to the construction of such closures as spigot valves molded of elastomeric plastic resins.

2. Description of the Prior Art

My U.S. Pat. No. 3,400,866, U.S. Pat. No. 3,972,452 to W. C. Welsh and U.S. Pat. No. 4,211,348 to W. R. Scholle, being representative of the prior art, all utilize an integral valve formed as a closure diaphragm of elastomeric plastic material which opens by toggle action of a finger manipulatable tab projecting from a central region of the diaphragm, the toggle action serving to distort the normally closed concave configuration of the diaphragm.

A recognized problem in bag-in-a-box packaging is the permeability to gases of the elastomeric plastic materials from which the closure diaphragms must be made for proper functioning. Such permeability results in the undesirable exchange of gases through the diaphragm between the liquid contents of the package and the atmosphere, as for example, the entering of atmospheric oxygen permitting undesirable oxidation of the packaged product and also the loss of flavor essences from the product to the atmosphere. One solution to this problem suggests providing a gas impermeable barrier of sheet material to be applied externally to the tubular spout after the bag is filled and closed with the diaphragm. This solution has its own disadvantages including the requirement of additional packaging steps and modifications of existing automatic packaging machinery.

A need, therefore, exists for an improved dispenser closure which will provide the advantages of the resiliency of elastomeric material, preserve the compatibility with high speed automatic filling and sealing machinery in packaging and be capable of solving the problem of undesirable gaseous exchange.

SUMMARY OF THE INVENTION

Among the objects of the invention is to satisfy the hereinbefore mentioned needs in bag-in-a-box disposable packaging of liquid commodities in relatively large containers by providing dispenser closure constructions which shall be easy to operate and comprise few and simple parts which may be fabricated of resinous plastic in quantity production by injection molding methods. An alternative to existing devices, including those described in the above mentioned U.S. Patents which feature the finger manipulated toggle action to effect delivery of the liquid, is herein described and has a push-to-dispense action which, in addition to being competitive in cost and of improved reliability, may incorporate an interior gas impermeable barrier which is broken or dislodged by the inward thrust of the initial manual dispensing action.

The dispenser closures, each of which snap onto and coact with a container mounted tubular spout, feature a two piece construction comprising a housing or cap incorporating a fixed valve seat and discharge port and an interior diaphragm mounted valve member. The housing has an integrally formed compressible hollow push button centrally located in a forwardly extending protective cup formed with a finger grip radially extending flange. The rearwardly extending end of the housing terminates in a sleeve for exterior snap-on engagement with the delivery end of the tubular spout. A conically shaped intermediate wall portion tapering from the sleeve to the hollow push button provides the valve seat which is formed with an opening located behind the cup flange serving as the discharge port from the tubular spout.

The interior valve member features an annular diaphragm molded to normally assume a forwardly convex configuration and having the outer periphery supported by a sleeve adapted for mounting by insertion into the tubular spout. A conical body, extending from the center of the diaphragm and tapering to a closed end wall, is suitably contoured to engage the housing valve seat, to close the discharge port opening and to locate the closed end wall against the push button when the diaphragm is in the normal convex configuration. The diaphragm is provided with a plurality of equally spaced openings through which liquid flows from the tubular spout and subsequently through the discharge port in the housing when the conical body is moved axially rearwardly to an unseated open position by inward finger pressure applied to the push button and the closed end wall, whereby the diaphragm is resiliently deformed to an invaginated configuration, returning to the convex, valve closing configuration upon release of the push button.

A modified dispenser closure incorporates an interior gas impermeable barrier formed as a dislodgeable cap which snugly closes the bore of the tubular spout and is mounted in stopper fashion on the free end of the sleeve of the interior valve member. Means is provided for dislodging the cap from the sleeve and spout. Such means may take the form of a knock-out skirt within the sleeve, which skirt, provided as an extension of and to move with the conical body, dislodges the cap from the sleeve and spout when the conical body is initially moved into an open valve position.

Another form of interior gas impermeable barrier utilizes a perforatable disc bonded to the edge of the valve member sleeve, the knock-out skirt being modified as a severing means for piercing the disc on the initial thrust of the conical body to the open valve position.

The attachment of a gas impermeable barrier to the sleeve of the interior valve member enables the barrier to provide a reliable closure positioned at the inlet end of the tubular spout and the overall construction of the dispenser closures is also compatable with automatic packaging equipment which receives an unfilled bag with the dispenser closure assembled on the tubular spout, and in sequence, removes the housing, removes the interior valve member with or without the barrier cap secured thereto, fills the bag, replaces the interior valve member, and where the barrier cap is present, simultaneously seals the inlet end of the tubular spout, and then replaces the housing.

DESCRIPTION OF THE PREFERRED EMBODIMENT

Figure 2:
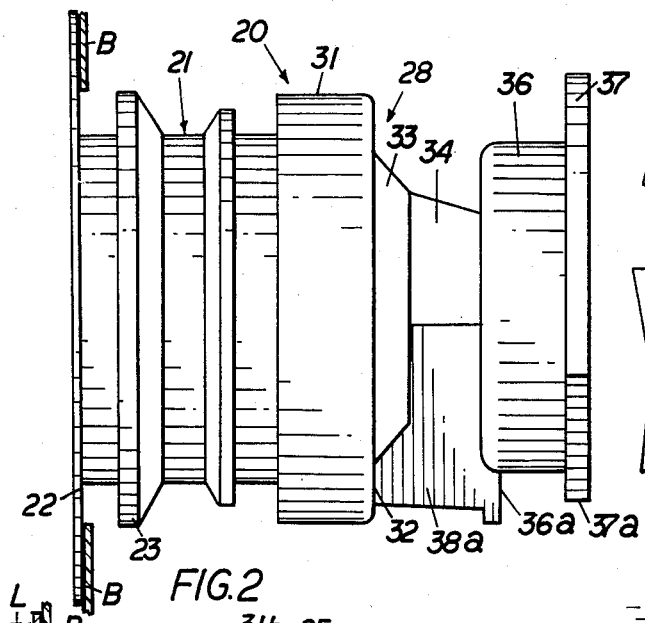
FIG. 2 is a side elevational view of the tubular spout and dispenser closure shown in FIG. 1.
Figure 1:
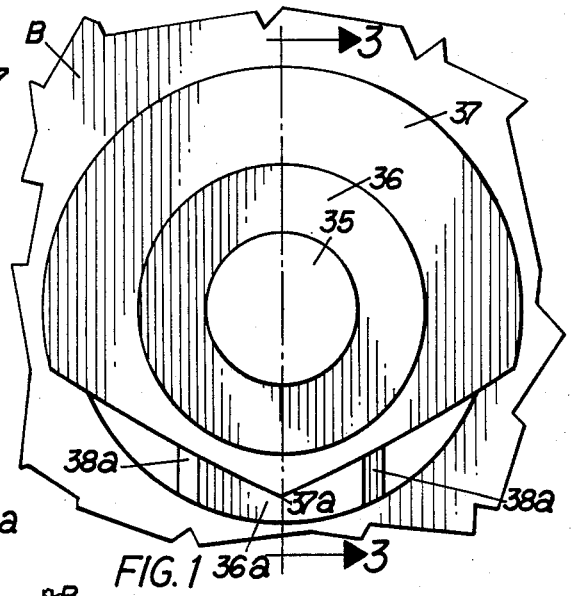
FIG. 1 is a front elevational view of a dispenser closure embodying the invention mounted on a tubular spout of a flexible plastic container.

Referring in detail to FIGS. 1 to 6, inclusive, of the drawings, 20 generally denotes a spigot assembly comprising a dispenser closure 28 mounted in snap-on engagement on the delivery end of a tubular spout 21, the opposite, inlet end of the latter having a conventional attachment flange 22 of relatively large diameter for a heat sealed connection to the wall of a container or bag B. Tubular spout 21, which may be molded of a semi-rigid resinous plastic, such as, polyethylene, vinyl or the like, has one or more radial flanges, herein shown as flanges 23 and 24, provided to meet requirements for engagement by the outer cardboard container and also the gripping means of automatic bag filling and sealing machinery. A bead 25, formed on the rim of the delivery end of tubular spout 21 provides specific structure hereinafter described to facilitate assembly and removal of dispenser closure 28.

Dispenser closure 28 is a two piece structure, both molded of an elastomeric resinous plastic material, such as, EVA (ethylene vinyl acetate), KRATON (trademark of a styrenebutadiene) or blends thereof, or other suitable polyolefins, polyvinyls and the like, and comprises a housing or cap 30 and an interior diaphragm mounted valve member 40. Housing 30 has a hollow interior which generally tapers from an open rear end sleeve 31 to a forwardly extending, axially centered, compressible, reduced thickness, hollow button 35 surrounded by a protective cup 36. A radial flange 37, extending from the edge of cup 36 as a finger grip, may have a generally circular periphery which includes a pair of straight line sections converging to an indexing point 37*a*. Sleeve 31 has an interior beveled edge 31*a* facilitating snap-on assembly with tubular spout 21, the interior surface of sleeve 31 being formed with an annular groove 31*b* shaped to conform to and engage the rounded exterior surface 26 of bead 25.

An intermediate section of housing 30 between sleeve 31 and cup 36 is constructed to provide a valve seat and discharge port for dispenser closure 28. To this end, the wall of housing 30 adjacent cup 36 is conically shaped to form valve seat 34 which tapers from supporting base portion 33 to push button 35, base portion 33 opening rearwardly into sleeve 31 and being connected thereto by a shoulder 32. The discharge port comprises an opening 34*a* in valve seat 34 which communicates with a discharge passageway 38 defined by opposite sidewalls 38*a* extending longitudinally between cup 36 and base portion 33. As shown in FIGS. 1, 2, 3 and 6, a rear facing section of cup 36 and a radial extension 36*a* therefrom between sidewalls 38*a* form the front wall of passageway 38 while front facing sections of base portion 33 and shoulder 32 between sidewalls 38*a* form the rear wall of passageway 38.

Figure 3:
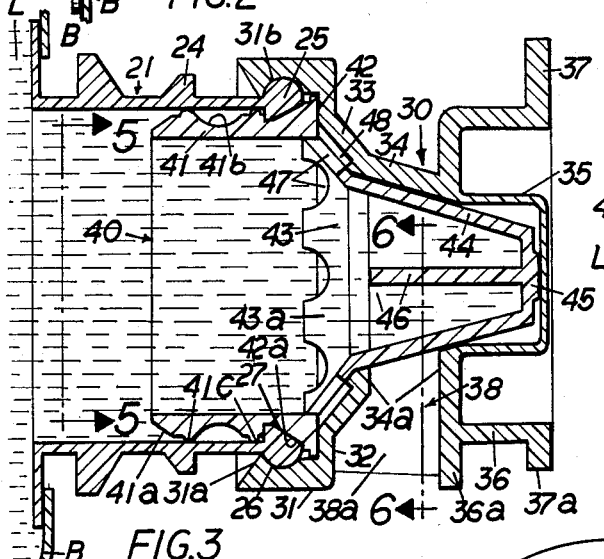
FIG. 3 is a sectional view taken on line 3—3 in FIG. 1 showing the interior diaphragm mounted valve member of the dispenser closure in a normally closed position.
Figure 4:
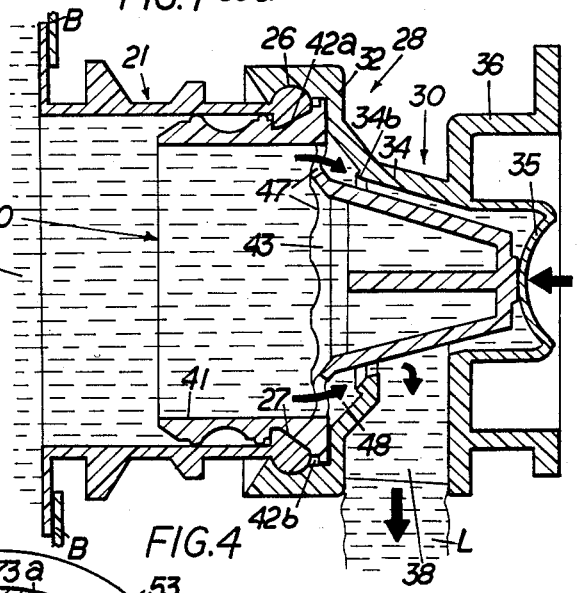
FIG. 4 is a sectional view similar to FIG. 3 but showing the valve member in an open, liquid dispensing position.
Figure 5:
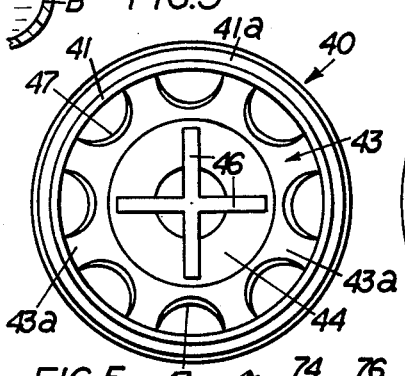
FIG. 5 is an elevational view of the interior end of the valve member as seen on line 5—5 in FIG. 3.
Figure 11:
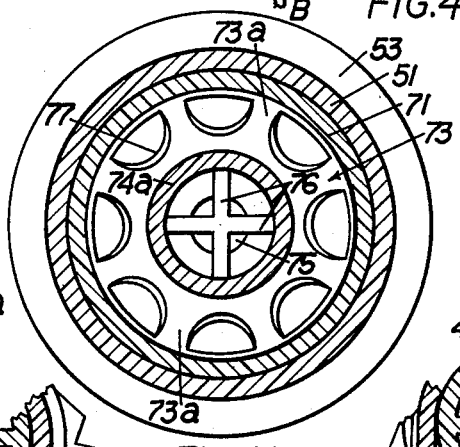
FIG. 11 is a sectional view taken on line 11—11 in FIG. 9.

Interior valve member 40 is a substantially hollow structure having exterior surface configurations for coacting with interior surfaces of tubular spout 21 and housing 30 and is seen to comprise a rearwardly opening sleeve 41 supporting an annular shaped diaphragm 43 having a conical valve body 44 forwardly projecting from the center thereof and terminating in a closed end wall 45. The exterior surface of sleeve 41 is suitably contoured to facilitate assembly and removal during the filling process of bag B. Thus, sleeve 41 is shown in FIG. 3 as formed with beveled edge 41*a* located to engage the beveled interior surface 27 of bead 25 to facilitate insertion of valve member 40 into tubular spout 21 and also as having a pair of relatively narrow annular ribs 41*c* separated by a relatively wider annular groove 41*b*. The medial end of sleeve 41 terminates in an exterior shoulder 42 which provides a reentrant groove adjacent the medial-most rib 41*c* having an inclined bottom surface 42*a* proportioned to engage bead beveled surface 27 as a stop for properly seating valve member 40 in tubular spout 21. The reentrant groove of shoulder 42 may also be formed to provide a relatively small annular groove 42*b* beyond bead 25 which is accessible when housing 30 is removed for gripping by the automatic filling machinery in performing the individual removal and replacement of valve member 40.

Annular diaphragm 43 connects to the interior edge of shoulder 42 and has a normally forwardly convex configuration which in assembly with housing 30 retains conical valve body 44 in closed position, namely, in contact with valve seat 34, to which the former conforms, sealing off opening 34*a* and with closed end wall 45 projecting fully into hollow push button 35 which is cooperatively retained thereby and by its own resiliency in a normally extended position. Conical body 44 and closed end wall 45 are suitably rigidified as by a pair of diametrically extending, perpendicularly intersecting, cross ribs 46, shown in FIG. 3 to extend through conical body 44 from a plane forwardly of diaphragm 43 to merge with end wall 45. Annular diaphragm 43 is formed with a plurality of openings 47, shown in FIG. 5 as eight in number, of semi-circular shape and equally spaced to provide eight webs 43*a* therebetween which cooperatively invaginate when deformed by the valve opening operation as hereinafter described and shown in FIG. 4. Openings 47 communicate the interior of sleeve 41 with a narrow annular space 48 between diaphragm 43 and base portion 33 of housing 30. To prevent leakage of liquid L from space 48 particularly in the region of discharge opening 34*a*, the interior of housing 30 between base portion 33 and valve seat 34 may be formed with an annular protuberance 34*b* which is contoured to engage the reentrant annular corner formed between diaphragm 43 and valve body 44.

Bag B, having been manufactured with tubular spout 21 onto which dispenser closure 28 is subsequently mounted as spigot assembly 20, is supplied to automatic liquid commodity filling machinery which first disengages and removes housing 30 from bead 25, exposing conical valve body 44 and small groove 42*b* for engagement by suitable gripping means of the machinery which removes interior valve member 40 from spout 21. After bag B is filled through open spout 21, valve member 40 is replaced and closure completed by snapping housing 30 onto bead 25 enclosing conical valve body 44. Point 37*a* of flange 37 and/or sidewalls 38*a* may serve as indexing means enabling the machinery to align discharge passageway 38 in perpendicular relation to the bottom of bag B to discharge liquid L by gravity flow in a vertically downward direction when filled bag B is supportingly packaged in its cardboard box with spout 21 projecting horizontally in a liquid dispensing position.

The practical utility and operation of spigot assembly 20 will now be apparent. As is clear from FIG. 3, the resiliency of diaphragm 43 augmented by the pressure of liquid L against the closed hollow interior of conical body 44 retains the latter in fully seated position in valve seat 34, effectively sealing opening 34*a*, while cup 36 protects push button 35 against accidental depression during handling of the filled container.

Liquid L may be readily dispensed by the conventional one hand, three finger manipulation whereby the index and middle fingers engage the rear side of flange 37 enabling an inward force to be applied to push button 35 by the thumb. Such inward force, applied in the direction of the arrow shown in FIG. 4, deforms push button 35 and unseats conical valve body 44 when annular diaphragm 43 is also deformed by the inward force to an invaginated configuration. This unseating of conical valve body 44 permits liquid L to flow from spout 21 through sleeve 41, openings 47, annular space 48, which is enlarged by the unseating, and then downwardly through opening 34*a* into discharge passageway 38 as indicated by the arrows in FIG. 4. Upon release of the force on push button 35, the latter and annular diaphragm 43 immediately return to their normal configurations shown in FIG. 3, reseating conical valve body 44, closing opening 34*a* and cutting off the flow to discharge passageway 38.

A spigot assembly 50, modified to provide an interior gas impermeable barrier embodying the invention, is shown in FIGS. 7 to 12, inclusive, as comprising dispenser closure 58 mounted in snap-on engagement on the delivery end of tubular spout 51 which is substantially similar to spout 21 but preferably shorter in length to facilitate the operation of the gas impermeable feature and thus is provided with a single flange 53 between attachment flange 52 and bead 55.

Dispenser closure 58 is a three piece structure comprising housing 60 and interior member 70, both molded of an elastomeric material similar to that of dispenser closure 28 and a dislodgeable gas barrier cap 79 made of a gas impermeable plastic material similar to that of tubular spouts 21 and 51. Housing 60 has an open rear end sleeve 61, a diameter reducing base portion 63, a valve seat 64 formed with annular protuberance 64*b* and opening 64*a* into discharge passageway 68 having opposite sidewalls 68*a*, a compressible hollow button 65 terminating valve seat 64 and a protective cup 66 having a radial flange 67 with indexing point 67*a*, all resembling corresponding structure in housing 30. In greater detail, sleeve 61 has an edge formed with an interior bevel 61*a* and an interior annular groove 61*b* sized and positioned for snap-on engagement with the rounded surface 56 of bead 55. A relatively narrow groove 61*c* is also formed forwardly of groove 61*b* having a wall coplanar with interior shoulder 62. A rather thick radial flange 62*a*, which provides means for handling housing 60 by automatic filling and capping machinery, has a flat side facing sleeve 61 and a forward facing surface merging with the concave surface of base portion 63. Where desired, a further stiffening means may be provided for cup 66, such as the pair of diametrically aligned webs 66*a* which are inclined away from button 65 leaving the latter free for operation.

Interior valve member 70 has a rearwardly opening sleeve 71 formed with an outer surface 71*b* tapering slightly rearwardly to conform to the interior surface of tubular spout 51 and terminating in a flat rear edge 71*a* against which cap 79 abuts when mounted on sleeve 71. The medial end of sleeve 71 has a radially extending flange providing exterior shoulder 72 on which interior shoulder 62 of housing 60 seats. A stepped rear side of the flange abuts the flat front edge 57 of bead 55 as a stop for properly seating valve member 70 in tubular spout 51 and provides a small flange 72*a* coplanar with shoulder 72 and spaced from bead edge 57 by a shallow annular groove 72*b*.

Figure 9:
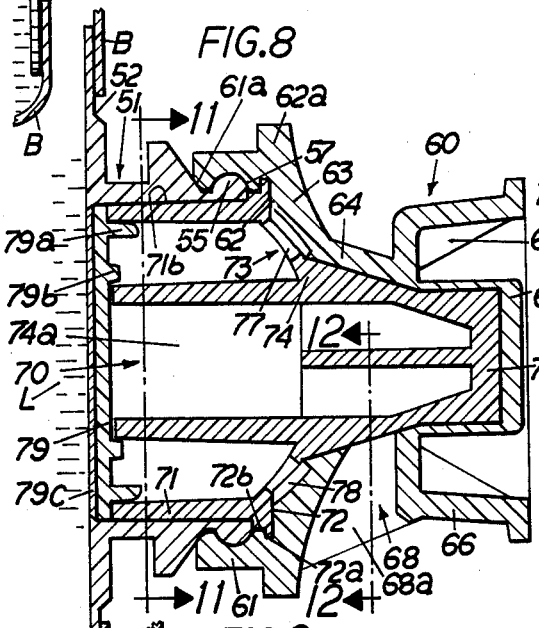
FIG. 9 is a sectional view taken on line 9—9 in FIG. 7 showing the interior gas impermeable barrier cap in operative, sealing position in the tubular spout.

Interior valve member 70, also structurally resembling valve member 40 of dispenser closure 28, has an annular diaphragm 73 connecting to the interior edge of shoulder 72 and being formed with a plurality of equally spaced semi-circular openings 77 into space 78 and providing webs 73*a* therebetween. Conical valve body 74 projects forwardly from the center of diaphragm 73 conforming to valve seat 64 as a closure for opening 64*a* and engaging annular protuberance 64*b*. Valve body 74 also extends forwardly, projecting fully into hollow push button 65, terminates in closed end wall 75 and is rigidified by ribs 76. To provide a knock-out means for barrier cap 79, valve body 74 is integrally formed with a rearward extension herein shown as a tube or skirt 74*a* concentric with sleeve 71 and of a length to contact cap 79 when the latter is mounted on sleeve 71 and valve body 74 is in the normally closed position as seen in FIG. 9.

Barrier cap 79 is formed as a plug or stopper having an overall diameter sized to fit the inlet end of tubular spout 51 and having a reduced diameter plug portion for telescopingly engaging the interior of sleeve 71 at the open end thereof. The plug portion which may be in any suitable form is herein shown as a hollow extension or sleeve 79*a* having a rounded edge to facilitate assembly on sleeve 71. The plug portion side of cap 79 also may be provided with an annular rib 79*b* concentric with sleeve 79*a* and of a diameter for containing the free end of skirt 74*a*. When desired for more efficient gas impermeability, a relatively thin disc 79*c* of polyethylene-coated aluminum may be suitably bonded to the exposed surface of cap 79.

In use, three piece dispenser closure 58 may be preassembled by mounting barrier cap 79 on the end of sleeve 71 either before or after interior valve member 70 is connected to housing 60 which is readily accomplished with the aid of interior bevel 61*a* and the rounded contour of the dividing rib separating annular groove 61*b* from narrow groove 61*c* enabling small lateral flange 72*a* to snap into narrow groove 61*c*. Spigot assembly 50 is completed on bag B by snapping the pre-assembled dispenser closure 58 onto tubular spout 51. At the point of filling bag B with liquid L, the machinery automatically removes assembled dispenser closure 58 utilizing flange 62*a* and, after filling, replaces dispenser closure 58 with barrier cap 79 sealing the inlet end of tubular spout 51 against liquid L as well as against an exchange of gases during the shelf life of filled bag B which no longer will be adversely affected by such gaseous exchange.

Figure 10:
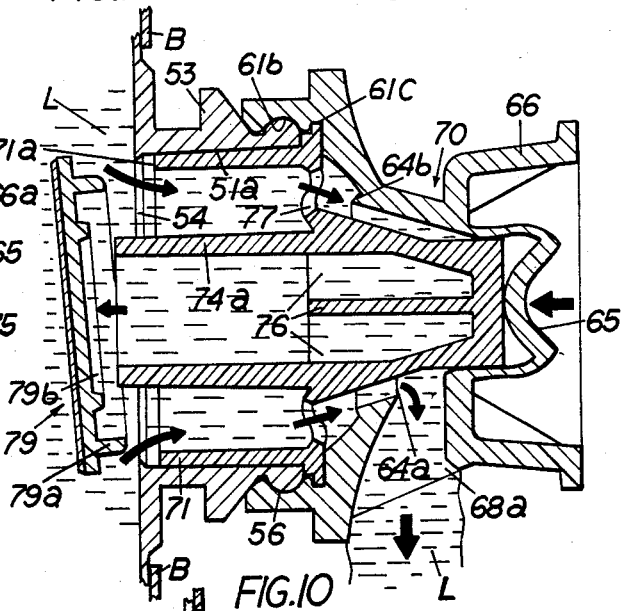
FIG. 10 is a sectional view similar to FIG. 9 but showing the valve member after initial actuation to the open position with the barrier cap dislodged for delivery of liquid through the tubular spout and discharge port.

The first time liquid L is dispensed by an inward force applied to push button 65, the latter is compressed in the direction of the arrow shown in FIG. 10 and moves conical valve body 74 inwardly to unseat from valve seat 64 as annular diaphragm 73 invaginates. Skirt 74*a*, which moves with valve body 74, dislodges cap 79 from engagement in both sleeve 71 and tubular spout 51. As cap 79 falls away into bag B opening tubular spout 51, liquid L flows from bag B through the annular space between sleeve 71 and skirt 74*a*, then through openings 77 and annular space 78 and downwardly through opening 64*a* into discharge passageway 68 as indicated by the arrows in FIG. 10. Upon release of push button 65, valve body 74 returns to closed position and is ready for subsequent dispensing operations in the same manner as dispenser closure 28.

Figure 15:
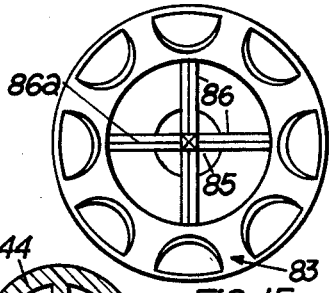
FIG. 15 is an elevational view of the interior side of the valve member and integrally formed punch as seen on line 15—15 in FIG. 13.
Figure 12:
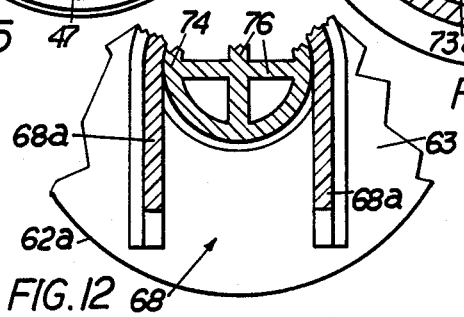
FIG. 12 is a sectional view taken on line 12—12 in FIG. 9 showing details in the region of the discharge port.
Figure 6:
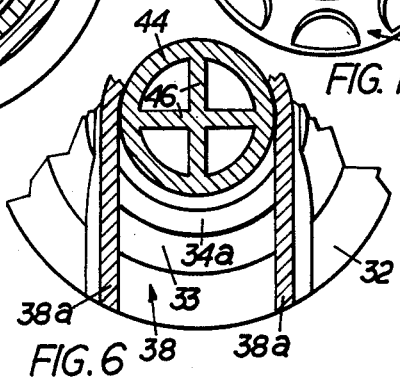
FIG. 6 is a fragmentary sectional view taken on line 6—6 in FIG. 3 showing details of construction in the region of the discharge port.
Figure 8:
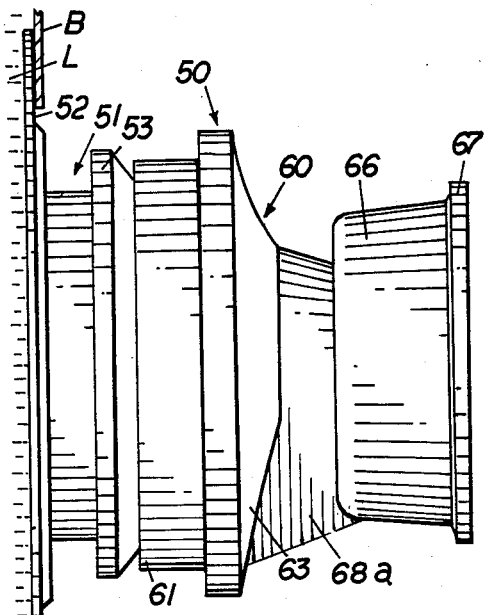
FIGS. 7 and 8 are front and side elevational views, respectively, of a modified tubular spout and dispenser closure embodying the invention.
Figure 7:
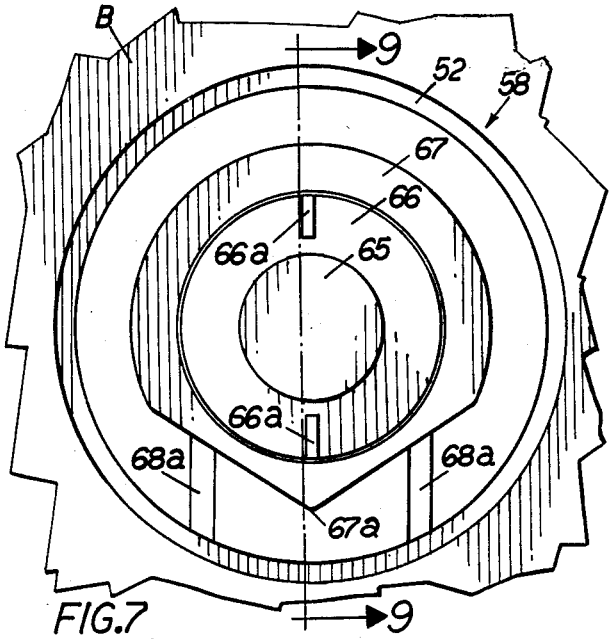
Figure 13:
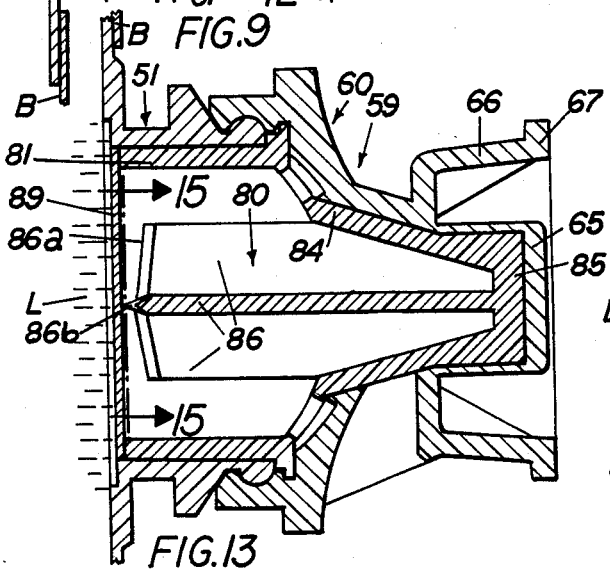
FIG. 13 is a sectional view similar to FIG. 9 but having the gas impermeable barrier modified as a puncturable disc shown in sealing position and the valve member integrally formed with a pointed punch.
Figure 14:
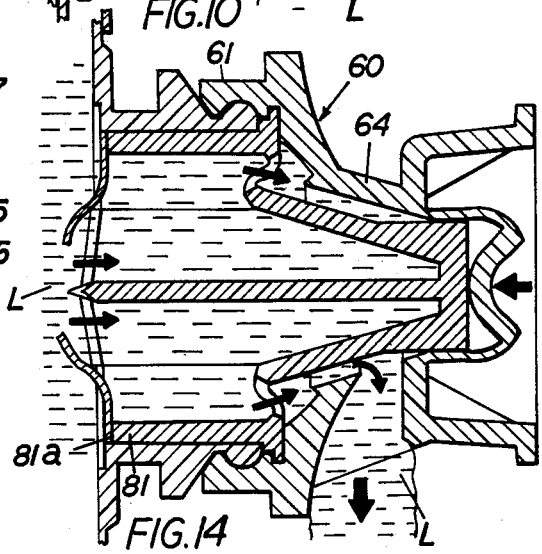
FIG. 14 is a sectional view similar to FIG. 13 but showing the valve member after initial actuation to open position with the barrier perforated for delivery of liquid through the tubular spout and discharge port.

As a modification of dispenser closure 58 utilizing the same housing 60, dispenser closure 59 is shown in FIGS. 13, 14 and 15 assembled on tubular spout 51 and comprising, in combination with housing 60, an interior valve member 80 on which a relatively thin, gas impermeable but puncturable barrier disc 89 is mounted instead of the stopper-like cap 79. Interior valve member 80, having sleeve 81, annular diaphragm 83, conical valve body 84 and closed end wall 85, all similar to the corresponding structure of valve member 70, is modified to provide extended cross ribs 86 in place of skirt 74*a*. Disc 89 may be made of a polyethylene coated aluminum sheet which is suitably bonded to the flat rear edge 81*a* of sleeve 81. Extended cross ribs 86 provide stiffening means within valve body 84 and also extend through sleeve 81 terminating at disc 89 in suitable puncturing means, such as double beveled edges 86*a* which incline slightly to a sharpened center point 86*b* located at the longitudinal axis of valve member 80 along which ribs 86 intersect.

Bag B may be equipped with dispenser closure 59 and filled with liquid L in the same manner as hereinbefore described for spigot assembly 50. Likewise, the force applied to push button 65 in the first dispensing operation, as illustrated in FIG. 14, unseats conical valve body 84 simultaneously causing point 86*b* and edges 86*a* to puncture disc 89 and tear an opening therethrough for the flow of liquid L into the hollow interior of valve member 80 to be dispensed as indicated by the arrows, flowing through the openings in diaphragm 83 and valve seat 64.

It is contemplated, where desired, that various specific structure shown in spigot assembly 20 be substituted for corresponding structure in spigot assembly 50 and vice versa. For example, the front facing wall and side walls 68*a* of the discharge passageway 68 in housing 60 may be made with a front wall extension similar to radial extension 36*a* of protective cup 36 in housing 30, or bead 25 and interior wall of spout 21 may be formed as bead 55 and wall 51*a* of spout 51 to accommodate an interior valve member 40 having a sleeve similar to sleeve 71 and the interior of housing sleeve 31 formed with a small annular rib for engaging small annular groove 42*b* whereby dispenser closure 28 may be removed and replaced as an assembled unit during the filling operation of bag B, or an arrangement made whereby housing 60 and interior valve body 70 may be separately removed from and replaced on spout 51. Also, cross ribs 76 may be extended and blunted to serve as knock-out means for cap 79 in place of skirt 74*a*.

Figure 16:
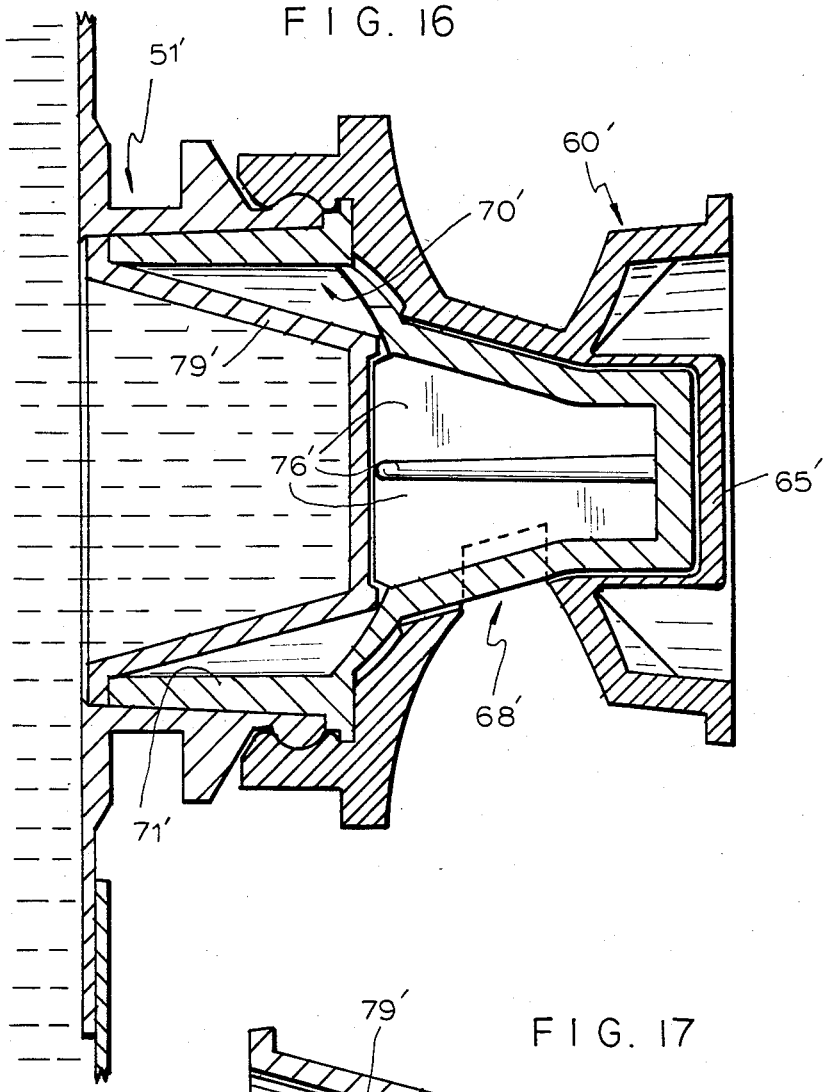
FIG. 16 is a sectional view of a modified tubular spout and dispenser closure.
Figure 17:
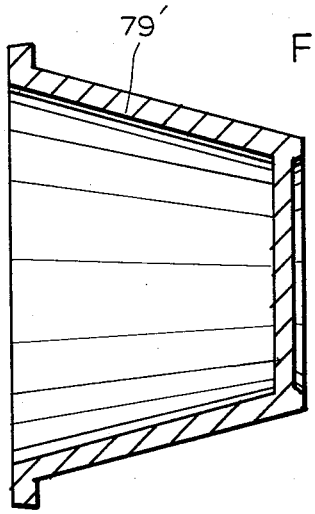
FIG. 17 is a section of a hat shaped barrier cap forming part of the assembly as shown in FIG. 16.

FIGS. 16 and 17 show a further embodiment of a three piece dispenser closure contemplated by the invention. Parts in this embodiment having functions similar to those in the FIG. 9 embodiment are identified by the same reference characters except for the addition of prime mark designations.

As will be seen in FIGS. 16 and 17 a barrier cap 79' is provided which is generally hat shaped. The housing or cap 60' of this embodiment is generally similar to housing 60 of FIG. 9, the bottom wall of cap 60' however being generally downwardly and inwardly inclined, instead of being generally flat as in FIG. 9, to facilitate depression of push button 65'. Interior valve member 70' is also generally similar to valve member 70 of FIG. 9 except that the tube or skirt 74*a* rearward extension of the valve body 74 of FIG. 9 is absent in the FIG. 16 embodiment. In this embodiment because of the proximity of the forward wall of the hat shaped barrier cap to ribs 76', upon depressing button 65', the ribs will urge the barrier cap from its sealing engagement with sleeve 71' and from tubular spout 51' within which the barrier cap closely fits as seen in FIG. 16. Fluid is dispensed, as in previously described embodiments, through discharge passageway 68' on depressing push button 65'.

The dispenser closures and tubular spouts herein disclosed are seen to achieve the several objects of the invention and to be well adapted to meet conditions of practical use. As various possible embodiments might be made of this invention, and as various changes might be made in the disclosed closures and spouts, it is to be understood that all matters herein set forth or shown in the accompanying drawings are to be interpreted as illustrative and not in a limiting sense.

What is claimed is:

1. A dispenser closure of an elastomeric plastic material adapted for mounting on the delivery end of a tubular spout, comprising a housing enclosing a valve member, said housing having a valve seat formed with an opening to the exterior and a forward extension beyond said opening formed as a hollow inwardly compressible push button, said valve member being a one piece structure comprising a rearwardly extending sleeve for mounting said tubular spout, an annular diaphragm having openings therethrough and being formed as a normally forwardly convex extension of said sleeve, a valve body extending forwardly from the center of the diaphragm and contoured to engage said valve seat to close said opening when the diaphragm is in convex configuration and having a closed end wall extension projecting into said hollow push button, said annular diaphragm being resiliently deformable into invaginated configuration by an inward axial force applied to said closed end wall through the push button to unseat said valve body whereby to permit a commodity to flow through said openings in the diaphragm, between said valve body and valve seat and through said valve seat opening to the exterior, said housing having a sleeve of a diameter for fitting the exterior of the tubular spout, said valve member sleeve being concentrically spaced from said housing sleeve and defining a space therebetween in which said tubular spout is adapted to be received.

2. The dispenser closure defined in claim 1 in which said valve seat and valve body are conical in shape and taper forwardly to terminate in said push button and closed end wall, respectively.

3. The dispenser closure defined in claim 1 in which said annular diaphragm openings are equally spaced forming equally sized webs therebetween which cooperatively deform from said convex to said invaginated configurations.

4. The dispenser closure defined in claim 2 in which said valve body and diaphragm form an annular reentrant corner therebetween and said housing has an annular protuberance engaging said annular corner as a leakage preventing aid when said diaphragm and valve body are in closed position.

5. The dispenser closure defined in claim 1 wherein interengaging flange and groove means medial of said sleeve retains said housing and valve member in assembly for removal and replacement as a unit on said tubular spout during liquid filling.

6. The dispenser closure defined in claim 5 in which said housing has a radial flange intermediate the ends thereof serving as a manipulating means for automatic packaging machinery performing said liquid filling.

7. The dispenser closure defined in claim 2 in which said housing has a sleeve of predetermined diameter for exterior snap-on engagement on said tubular spout, said sleeve extending rearwardly from a shoulder, said conical valve seat being of reduced diameter with respect to said predetermined diameter and extending forwardly from said shoulder, a cup having a bottom wall parallel to and spaced from said shoulder and an annular sidewall spaced from and surrounding said push button providing protection against accidental depression of the push button.

8. The dispenser closure defined in claim 7 in which said valve seat opening is located between said shoulder and cup bottom wall, and an exterior discharge passageway extending radially from said valve seat opening defined by said shoulder and cup bottom wall and a pair of spaced sidewalls extending therebetween.

9. The dispenser closure defined in claim 1 in which said housing has a sleeve of a diameter for fitting the exterior of said tubular spout, said valve member sleeve being concentrically spaced from said housing sleeve and of a diameter for fitting the interior of said tubular spout, said housing and valve member each having means for said snap-on mounting on said tubular spout enabling said housing and valve member to be independently removed and replaced.

10. A dispenser closure for a tubular spout having an inlet end mounted on and communicating with a liquid container and an opposite delivery end, the dispenser closure being molded of an elastomeric plastic material adapted for snap-on mounting on said delivery end and including a sleeve fitting the interior of the tubular spout, said sleeve terminating in an inner end located adjacent said tubular spout inlet end, a gas impermeable sealing means attached to said sleeve inner end as a barrier within said spout at said inlet end, said dispenser closure comprising a housing extending forwardly from said spout delivery end formed as a valve seat having a valve opening and a hollow compressible push button projecting forwardly of said valve opening, said housing, except for said valve opening, completely closing said tubular spout delivery end, said housing having a sleeve of a diameter for fitting the exterior of the tubular spout, and a one piece valve member mounted within said housing and having a forwardly extending valve body normally closing said valve opening and having an end portion extending into said hollow push button, said valve member including said sleeve which rearwardly extends from a resilient diaphragm, with openings therein, forming part of the valve member, between said valve body and said sleeve, said valve member sleeve being concentrically spaced from said housing sleeve and defining a space therebetween in which said tubular spout is adapted to be received, said valve body being movable rearwardly by inward compression of said push button and having operating means, operable on rearward movement of said valve member, to open said valve opening and simultaneously remove said gas impermeable sealing means as as barrier enabling liquid from said container to flow through said spout to be dispensed through said valve seat opening, said valve body returning to said normally closed position upon release of said push button, the liquid from said container being available in said spout for subsequent dispending through said valve opening by inward compression of said push button.

11. The dispenser closure defined in claim 10 in which said impermeable sealing means is a cap for said sleeve inner end.

12. The dispenser closure defined in claim 11 in which said operating means is a rearwardly extending portion of said valve body and comprising a skirt concentric with said sleeve adapted to effect said barrier removal by dislodging said cap from said sleeve and tubular spout on said rearward movement of the valve member.

13. The dispenser closure defined in claim 10 in which said gas impermeable sealing means is a puncturable disc bonded to said inner end, and said operating means is a rearwardly extending portion of said valve body which includes means for puncturing said disc to effect said barrier removal.

14. A dispenser closure for a tubular spout having an inlet end mounted on and communicating with a liquid container and an opposite delivery end, the dispenser closure being molded of an elastomeric plastic material adapted for mounting on said delivery end and comprising a housing enclosing a valve member, said housing having a valve seat formed with an opening to the exterior and a forward extension beyond said opening formed as a hollow compressible push button, said valve member having a sleeve fitting the interior of the tubular spout, an annular diaphragm having openings therethrough and being formed as a forward extension of said sleeve molded to assume a normally convex configuration, a valve body extending from the center of the diaphragm contoured to engage said valve seat to close said opening when the diaphragm is in said convex configuration and having a closed end wall extension projecting into said hollow push button, said valve member sleeve terminating in an inner end located adjacent said tubular spout inlet end, a gas impermeable sealing means formed as a cap for said sleeve inner end and providing a barrier within said spout at said inlet end, said valve member having operating means operable on inward movement of said push button to dislodge the cap, inward movement of the push button also resiliently deforming said annular diaphragm into an invaginated configuration by an inward axial force applied to said closed end wall through the push button to unseat said valve body and simultaneously dislodge by said operating means said cap from said sleeve and tubular spout whereby liquid in said container fills said spout and flows through said openings in the diaphragm, between said valve body and valve seat and through said valve seat opening to the exterior, said housing having a sleeve of a diameter for fitting the exterior of the tubular spout, and interengaging flange and groove means medial of said housing and valve member sleeves for retaining said housing in assembly with said valve member and cap for removal and replacement as a unit on said tubular spout during liquid filling.

15. The dispenser closure defined in claim 14 in which said housing has a radial flange medial of said housing sleeve and adjacent thereto serving as a manipulating means for automatic packaging machinery performing said liquid filling.

16. The dispenser closure defined in claim 14 in which said valve seat and valve body are conical in shape and taper forwardly to terminate in said push button and closed end wall, respectively, said annular diaphragm openings being equally spaced forming equally sized webs therebetween which cooperatively deform from said convex to said invaginated configurations.

17. A dispenser closure comprising a housing of an elastomeric plastic material enclosing and operatively connected with a valve member of unitary construction and also of an elastomeric plastic material, said housing having a valve seat formed with an opening and a forward extension beyond said opening formed as a hollow inwardly compressible push button, said valve member comprising an annular resilient diaphragm, with openings therethrough, having a normally convex shape in a forward direction, a valve body integral with said resilient diaphragm, extending forwardly therefrom and having an outer surface configuration to engage the valve seat to close said opening when the diaphragm is in its normal convex configuration, said valve body having a closed end wall projecting into said hollow push button, said valve member further having a sleeve rearwardly extending from said diaphragm, said annular diaphragm being resiliently deformable into an invaginated configuration by an axial inward force applied to said closed end wall through the push button to unseat said valve body, said diaphragm, due to its resiliency, returning to its convex configuration on release of the actuating force on said push button, said housing having a sleeve coaxially related to and spaced from the valve member sleeve to define a space in which a tubular filling spout is adapted to be received, and interengaging flange and groove means medial of said housing and valve member sleeves for retaining said housing in assembly with said valve member for removal and replacement as a unit on said tubular filling spout.

18. The dispenser closure defined in claim 17 in which said valve seat and valve body are conical in shape and taper forwardly to terminate in said push button and closed end wall, respectively.

19. The dispenser closure defined in claim 17 in which said annular diaphragm openings are equally spaced forming equally sized webs therebetween which cooperatively deform from said convex to said invaginated configurations.

20. The dispenser closure defined in claim 18 in which said valve body and diaphragm form an annular reentrant corner therebetween and said housing has an annular protuberance engaging said annular corner as a leakage preventing aid when said diaphragm and valve body are in closed position.

21. The dispenser closure defined in claim 17, in which said valve member includes a skirt rearwardly extending from said diaphragm concentric with said valve member sleeve, a gas impermeable sealing means formed as a cap plug being provided for said sleeve inner end, said skirt terminating at said cap plug for dislodging the plug from said sleeve on unseating the valve body.

22. The dispenser closure defined in claim 17, in which a gas impermeable sealing means is attached to the end of said valve member sleeve, and means forming part of said valve body for dislodging said sealing means from the valve member sleeve on exerting an inwardly directed force on said closed end wall of the valve body through the intermediary of said inwardly movable push button, said inwardly directed force serving simultaneously to unseat the valve body from the housing seat.

23. A dispenser closure including an inlet and outlet for fluids, and valve means to control the flow of fluid from said inlet to said outlet, said valve means comprising a housing including an outer valve portion providing a fixed valve seat of predetermined shape and a valve actuation part at its forward end and a sleeve at its rear end, and an inner valve portion having a surface of a shape complementary to that of said fixed valve seat for normal sealing engagement therewith, said inner valve portion being movable between a valve closing position wherein said surface is in pressure contact with said fixed valve seat and a valve opening position wherein said surface is at least in part spaced from said fixed valve seat to allow fluid to pass therebetween from said inlet to said outlet, said inner valve portion being resiliently deformable by inwardly applied pressure to said valve actuation part to move said surface froms its valve closing position to its valve opening position, said inner valve portion being an integrally molded inner member comprising a forwardly extending valve body, a rearwardly extending sleeve and a resilient diaphragm, with openings therein, between the forwardly extending valve body and the rearwardly extending sleeve of the inner member for isolating inwardly directed forces on the valve body from said sleeve, said sleeve being adapted to mount a spout, said housing sleeve surrounding the valve body sleeve and adapted to receive therebetween a filling spout, said housing having a radial flange medial of said housing sleeve and adjacent thereto serving as a manipulating means for automatic packaging machinery.

24. A dispenser closure as defined in claim 23, wherein said outer valve portion is formed as an integrally molded outer valve part that includes said outlet and wherein said valve actuation part is of reduced wall thickness compared to that of the remaining portions of said part.

25. The dispenser closure defined in claim 10, in which said gas impermeable sealing means is a hat shaped sealing cap engaging at its base said sleeve and extending thereunto, said operating means comprising ribs extending rearwardly from the front end of said forwardly extending portion of said resiliently mounted means and terminating proximate said hat shaped cap for dislodging the latter from said sleeve on inward movement of said push button.

26. The dispenser closure defined in claim 22, in which the gas impermeable sealing means is a hat shaped cap, said dislodging means comprising ribs extending rearwardly from the closed end wall of the valve body and terminating proximate said hat shaped cap for dislodging the latter from said sleeve portion of the valve member on applying an inwardly directed force on said closed end wall of the valve body through the intermediary of said inwardly movable push button.

* * * * *